United States Patent [19]

Østergaard

[11] 4,376,499

[45] Mar. 15, 1983

[54] CONTAINER WITH DISPENSING ELEMENT

[75] Inventor: Steen Østergaard, Gentofte, Denmark

[73] Assignee: Stig Ravn A/S, Farum, Denmark

[21] Appl. No.: 296,838

[22] Filed: Aug. 27, 1981

Related U.S. Application Data

[63] Continuation of Ser. No. 45,875, Jun. 6, 1979, abandoned.

[30] Foreign Application Priority Data

Jun. 7, 1978 [DK] Denmark ..... 2537/78

[51] Int. Cl.[3] ..... G01F 11/10

[52] U.S. Cl. ..... 222/339; 222/362; 222/476

[58] Field of Search ..... 222/184, 336, 339, 344, 222/353, 361, 362, 363, 452, 476, 526, 531, 533, 536, 540, 344, 364

[56] References Cited

U.S. PATENT DOCUMENTS

| | | | |
|---|---|---|---|
| 1,277,406 | 9/1918 | Gibbons | 222/339 |
| 1,369,740 | 2/1921 | Gibbons | 222/452 X |
| 1,745,287 | 1/1930 | Wolfe | 222/364 |
| 1,949,387 | 2/1934 | Hardcastle | 222/353 X |
| 2,050,756 | 8/1936 | Kubo | 222/364 X |
| 2,533,449 | 12/1950 | Fraser | 222/364 |
| 2,539,283 | 1/1951 | Strachan | 222/363 X |
| 3,568,893 | 3/1971 | Becker | 222/363 |

FOREIGN PATENT DOCUMENTS

| | | |
|---|---|---|
| 966906 | 8/1964 | United Kingdom . |
| 1052698 | 12/1966 | United Kingdom . |

*Primary Examiner*—Robert B. Reeves
*Assistant Examiner*—Edward M. Wacyra
*Attorney, Agent, or Firm*—Watson, Cole, Grindle & Watson

[57] ABSTRACT

A container which includes a dispensing element for dispensing granular materials e.g., peanuts or almonds, wherein the container includes a dispensing opening in its side wall adjacent its lower end, wherein, an outwardly projecting curved roof part is arranged along the upper part of the dispensing opening and an inwardly projecting bottom part is provided along the lower part of the dispensing opening, and wherein the dispensing element is pivotally supported between the roof part and the bottom part and the upper surface of the dispensing element extends generally from the rear part of the bottom part to the front part of the roof part, the dispensing element including a handle for pivoting the dispensing element from a generally horizontal position to a downwardly and outwardly tilting position, the dispensing element being, moreover, provided with a skirt which in all positions of the dispensing element overlaps the bottom of the container.

2 Claims, 5 Drawing Figures

CONTAINER WITH DISPENSING ELEMENT

This application is a continuation application of application Ser. No. 45,875, filed June 6, 1979, now abandoned.

BACKGROUND OF THE INVENTION

When serving so-called "snacks", e.g. salted almonds, peanuts and the like granular materials, it is usual to serve such snacks in bowls so that persons may serve themselves. However, this is an unhygienic form for serving, and accordingly it is an object of the present invention to provide a dispenser for containing and dispensing granular material, e.g., peanuts or almonds, and by means of which the persons may serve themselves in such a way that a portion only of the contents of the container may be removed and without manual touching the material in the container.

SUMMARY OF THE INVENTION

According to the present invention this object is achieved by a dispenser which includes a container and a dispensing element for delivering granular materials, e.g. peanuts or almonds, and which according to the present invention is characterized by the container including a dispensing opening in its side wall adjacent its lower end, an outwardly projecting curved roof part arranged along the upper part of the dispensing opening and an inwardly projecting bottom part provided along the lower part of the dispensing opening, the dispensing element being pivotally supported between the roof part and the bottom part, the upper surface of the dispensing element extending generally from the rear part of the bottom part and to the front part of the roof part, the dispensing element including a handle for pivoting the dispensing element from a generally horizontal position, the dispensing element moreover, at the reverse part, being provided with a skirt which in all positions of the dispensing element overlaps the bottom part. By means of this construction the material accommodated in the container can be collected upon the upper surface of the dispensing element and inside the roof part, and such material will, by tilting the dispensing element by means of the handle, slide outwardly through the opening along the upper surface of the dispensing element in such a way that a person can dispense the material into his hand by pivoting the dispensing element. At the same time, the material will not fall below the dispensing element in the container due to the overlap between the skirt of the dispensing element and the bottom part. Accordingly, a person who withdraws a portion of the material cannot touch the material accommodated in the container.

An embodiment of the container according to the invention is characterized by the roof part extending into the container, and the dispensing element comprising an edge part upstanding with respect to the upper surface of the dispensing element, the upstanding edge being shaped so as to abut the inwardly projecting roof part in the pivoted position of the dispensing element. By means of this construction an effective closing-off between the amount of material to be dispensed and the amount of material accommodated in the container is achieved during the dispensing of a portion of the material, and simultaneously an appropriate tilting movement of the dispensing element is achieved.

According to a further advantageous embodiment of the invention the container is characterized by the bottom part and the skirt part of the dispensing element being shaped as parts of a torus and being arranged coaxially. By means of this embodiment material is prevented from penetrating from the interior of the container and outwardly between the skirt part and the bottom part in such a way that the operation of the dispensing element is not disturbed.

According to a still further embodiment of the invention the container is characterized by the roof part being shaped as a part of a torus. By means of this embodiment it is achieved that the roof part and the skirt part of the dispensing element will abut closely with respect to each other in the pivoted position of the dispensing element so as to prevent a direct flow outwardly from the interior of the container.

In order to avoid the need for a manual movement of the dispensing element back to a non-discharge position, a position wherein the dispensing element collects material on the upper surface thereof, the dispensing element may, according to a still further embodiment, be provided with a spring so shaped and arranged that it causes the dispensing element to be biased in direction towards a generally horizontal position.

A particularly simple embodiment of the container is achieved when the spring is a hairpin-shaped spring, the curved portion of which is arranged in the dispensing element and the legs of which extend out through holes in the sides of the dispensing element and through holes in the bottom part and into the container, whereby the holes are aligned to each other in such a way that the spring constitutes the pivot axis of the dispensing element. This embodiment is advantageous because the spring will serve a double purpose, viz., both to return the dispensing element and as a pivot shaft for the dispensing element.

According to a still further embodiment of the container, the dispensing element may at the front part include a concave wall part which generally extends from the front end of the upper surface of the dispensing element to the lower end of the skirt of the dispensing element. By means of this construction the dispensing element may easily be tilted because the fingers of the hand which receive the amount of material dispensed may be positioned immediately below the upper surface of the dispensing element at the outlet end thereof.

DESCRIPTION OF THE PREFERRED EMBODIMENT

Figure 1:
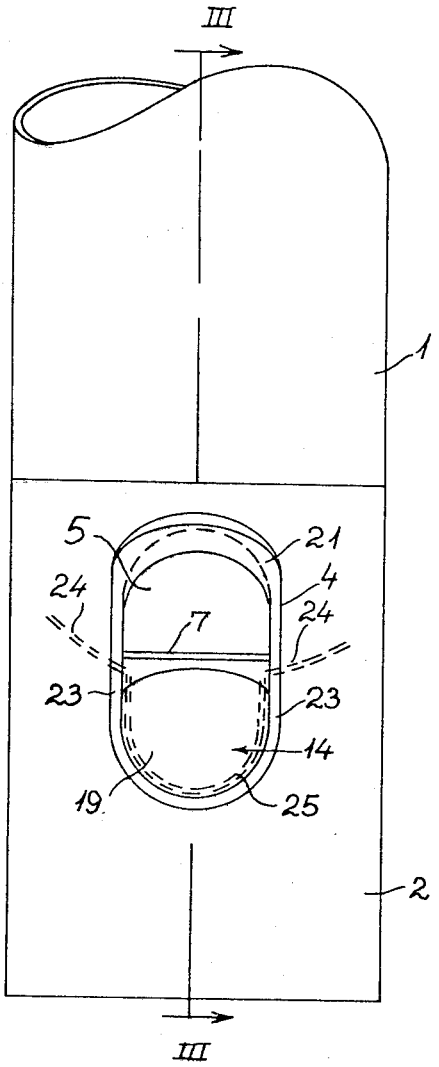
FIG. 1 is a front elevational view of an embodiment of the container according to the present invention.
Figure 2:
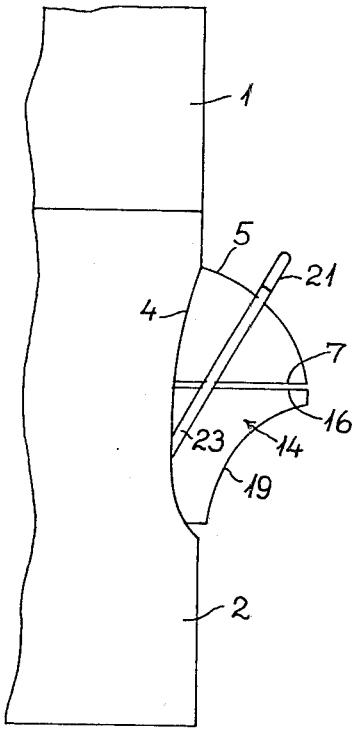
FIG. 2 is a fragmentary view seen from the left side of FIG. 1 illustrating the dispensing element of the container.

The container illustrated in the drawings comprises an upper circular cylindrical tube part 1, which is open at the upper end and which may be provided with a lid, and which serves to accommodate material in the form of granules to be dispensed, e.g., peanuts, almonds or the like "snacks".

The lower end of the tube 1 is secured to a container bottom part 2 comprising a circular cylindrical side wall 3, in the front side of which an elongated opening 4 having semi-circular upper and lower ends is provided. Along the upper part of the opening 4 an outwardly projecting roof part 5 is provided, this roof part being moulded integrally with the wall 3 (the complete container bottom part 2 can be manufactured of plastic by moulding). The roof part 5 is shaped as a part of a torus, i.e., it may be regarded as being generated by revolving a circular arch of 180° about an axis which extends perpendicular to the drawing plane of FIGS. 3 and 4, and which is provided with the reference numeral 6. The lower edge of the roof part curved in this way extends generally horizontally in the upright position of the container as shown at 7. According to the embodiment illustrated in the drawing, the roof part 5 is extended somewhat inwardly with respect to the wall 3 of the container bottom part in such a way that an inwardly directed projection 8 is formed, the inner surface of which extends flush with the inner surface of the outwardly projecting roof part 5. This curved form of the roof part 5 results in the roof part achieving an appearance which, at least to a certain degree, may be compared with the upper beak of a bird, e.g., a parrot.

Along the lower part of the opening 4 an inwardly projecting bottom part 9 is provided which is also moulded integrally with the wall 3 of the container bottom part 2 along the lower part of the opening 4. The bottom part 9 extends arch-shaped inwardly and upwardly in the container bottom part and merges at its inward upper edge 10 into a wall 11 inside the container bottom part 2. The wall 11 has an oblique conical shape and, accordingly, forms a hopper-like bottom for the tube 1, and so that the material contained in the tube 1 by means of the wall 11, due to gravity will be caused to move downwardly to the right in FIGS. 3 and 4. Accordingly, the oblique conical wall 11 also extends along the wall 3 along the upper edge of the wall 3, but the wall 11 ends at generatrixes which extend generally parallel with the lateral sides of the opening 4. In the downward direction the wall 11 merges into the upper edge 10 of the bottom part 9 which, like the roof part 5, may be imagined as being generated by revolving a circular arch of approximately 180° around the horizontal axis 6.

In the opening 4 a dispensing element is arranged, which in general is identified with reference numeral 14, and which is pivotable about the axis 6. The upper surface of the dispensing element consists of a plate 15 comprising a forward part 16 which, in the closed position of the dispensing element, extends generally horizontally, and an oblique rearward part 17 which, also in the closed position of the dispensing element extends a little downwardly and backwardly. At the rear end (i.e. towards the interior of the container) the dispensing element includes a skirt 18, which also may be regarded as being generated by revolving a circular arch of 180° about the axis 6, and which also, as the bottom part 9, has the shape of a part of a torus. The skirt 18 extends coaxially with the bottom part 9, and, accordingly, allows tilting of the dispensing element 14 about the axis 6 from the position illustrated in FIG. 3 to the position illustrated in FIG. 4. At the front end the dispensing element comprises a concave wall part 19 which generally extends from the front end of the upper surface 15 of the dispensing element 14 to the lower end of the skirt 18 of the dispensing element. However, at the transition between the wall part 19 and the skirt 18 a shoulder 20 is provided. From the explanation given above it will be understood that this shoulder 20 extends along a circular arch of approximately 180°, seeing that the shoulder follows the skirt 18.

A generally U-shaped handle 21 is secured to the tilting device 14 and extends, in the closed position of the dispensing device (FIG. 3), with a small clearance 22 around the roof part 5, and the ends 23 of the handle are secured to the sides of the dispensing element 14 as it clearly appears from FIG. 1. Due to this shape and arrangement of the handle 21, the beak shape of the device is underlined, seeing that the handle may appear like the nose beak of a parrot. This illusion is also stressed by the concave wall part 19 of the dispensing element 14.

Figure 3:
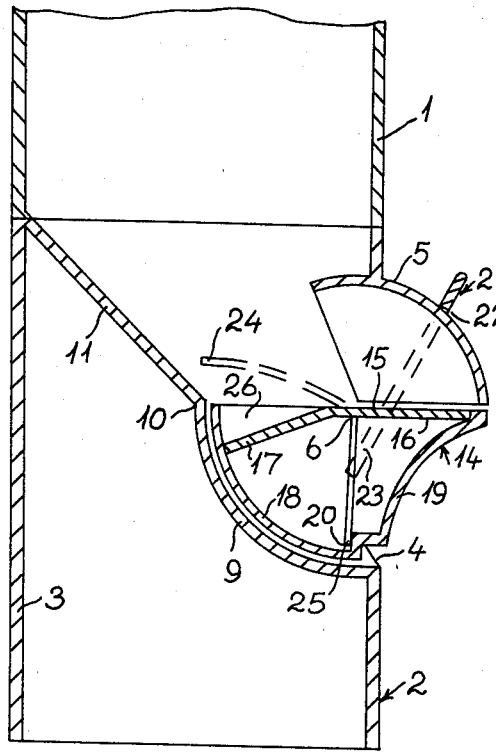
FIG. 3 is a cross-sectional view taken along line III—III in FIG. 1 illustrating the dispensing element in its closed position.
Figure 4:
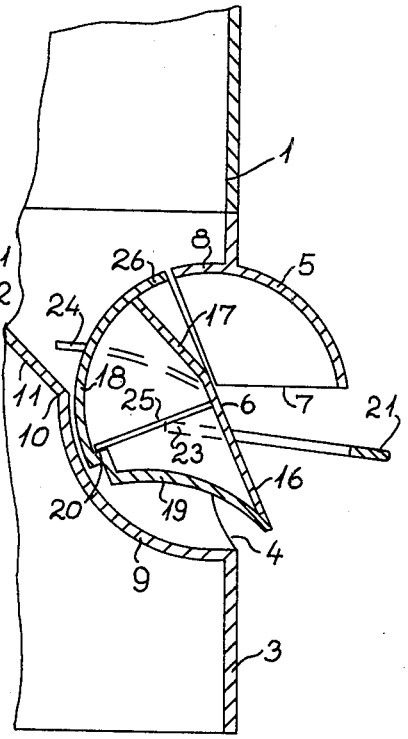
FIG. 4 is a cross-sectional view corresponding to FIG. 3, but illustrating the device in its open position.
Figure 5:
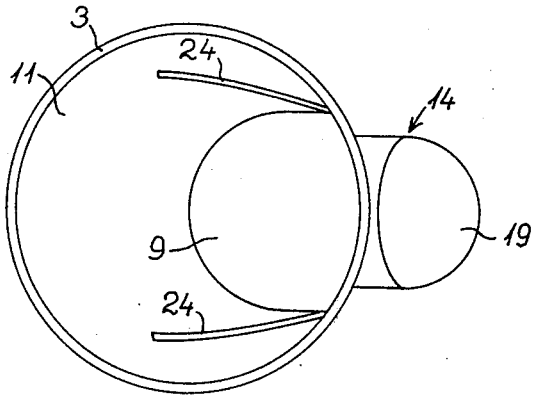
FIG. 5 is a bottom view of the container of FIG. 3.

The dispensing element 14 is pivotally supported so as to be tilted by means of the handle 21 from the position illustrated in FIG. 3 to the position illustrated in FIG. 4, and the tiltability is provided by means of a wire spring 24. The wire spring 24 has a hairpin-like shape provided with a bend portion 25, the shape and arrangement of which clearly appears from FIG. 1. The U-shaped portion extends along the inner surface of the skirt 18 of the dispensing element 14 and abuts against the shoulder 20. As it appears from FIG. 1, the wire spring 24 bends outwardly at the ends of the legs of the U-shaped bend, and the legs extend through holes in the side walls of the dispensing element 14 and which are aligned with the axis 6. From these holes the spring extends through holes (not illustrated on the drawing) which are positioned along the axis 6 and which extend through the sides of the bottom part 9 immediately inside the container wall 2 in such a way that the ends of the spring extend into the interior of the container bottom part 2 as it appears from FIG. 5, viz., into the space between the outer surface of the oblique conical wall 11 and the inner surface of the wall 3 of the container bottom part 2. The bend portion of the hairpin-shaped spring, accordingly, extends generally vertically downwardly in FIG. 3, whereas the legs of the spring first extend outwardly through coaxial holes in the sides of the dispensing element 14 and the sides of the bottom part 9, whereafter they extend rearwardly in the space between the wall 3 and the wall 11. Accordingly, the spring is pre-stressed so as to have a tendency to maintain the dispensing element 14 in the position illustrated in FIG. 3. Simultaneously, the spring also acts as a shaft for the dispensing element 14 due to the fact that the spring extends through the coaxially arranged holes.

As previously mentioned, the plate 15 comprises a downwardly and backwardly directed plate part 17, whereby an edge 26 which is upstanding with respect to the upper surface of the dispensing element is formed, and which forms a part of the skirt 18.

The container illustrated operates in the following way:

When a person wishes a portion of the material stored in the container, the person grips, e.g., by means of his thumb, the upper surface of the handle 21, and simultaneously holds his hand below the outwardly projecting roof part 5 and beneath the dispensing element 14. Now the handle 21 is pivoted from the position shown in FIG. 3 to the position shown in FIG. 4, whereby the portion of the material which is positioned upon the plate 15 and below the roof part 5, and which has been collected thereon due to the wall 11, slides along the plate portion 15 of the dispensing element and into the hand of the person in question, cf. FIG. 4. During such operation the concave wall part 19 offers space for the side edge of the hand. When the dispensing element has been tilted to the position illustrated in FIG. 4, the edge 26 of the skirt and the inwardly projecting roof part 18 will abut with respect to each other and will accordingly prevent a continuous outflow of material, due to the fact that a cutting-off with respect to the material inside the container is achieved. However, when the handle 21 is released and the dispensing element returns to the position illustrated in FIG. 3, renewed filling will take place, viz., by means of material which flows to the upper surface of the dispensing element from the supply accommodated within the tube 1 respectively the part of the container bottom part 2 which is defined by the wall 11.

Due to the coaxial arrangement of the bottom part 9 and the skirt 18 it will be understood that no matter what position the dispensing element occupies, the material will be prevented from penetrating downwardly into the bottom part 9 due to the fact that the skirt 18 has an extension in the circumferential direction such as to maintain overlap between the skirt 18 and the bottom part 9 in all positions of the dispensing element. Also, in the closed position of the dispensing element, no material may flow through the dispensing element due to the fact that the plate portion 15, in the closed position of the dispensing element 14, extends parallel with and closely adjacent the lower edge 7 of the roof part 5. The roof part 5 and the dispensing element 14 have, as seen in the vertical projection (FIG. 5) the same contour, so that the outer surface of the dispensing element 14 generally extends flush with the roof part 5.

I claim:

1. A container which is intended to store granular materials and which includes a dispensing element for discharging fixed quantities of the granular materials when manually operated said container including (a) a side wall which has a discharge opening therein, said discharge opening extend in a vertical direction when the container is positioned on a horizontal surface, the upper and lower ends of the discharge opening being semi-circular in shape, (b) an internal floor formed by a lower part and an upper part, the lower part extending from the side wall adjacent the lower end of the discharge opening upwardly and inwardly into the container to an upper edge which lies in a horizontal plane that extends through a line located at about the middle of the discharge opening, the lower part having a circular arch-shaped cross-section (shaped as a part of a torus), the upper part extending upwardly from the upper edge of the lower part and merging with the container side wall, (c) an outer roof part which extends outwardly of the container side wall adjacent the edge of the upper end of the discharge opening and downwardly to a lower edge which lies in a horizontal plane which extends through a line located at about the middle of the discharge opening, the roof part having a circular arch-shaped cross-section (shaped as a part of a torus), and (d) an inner roof part which extends inwardly of the container side wall adjacent the edge of the upper portion of the elliptical dispensing opening and downwardly a short distance, the inner roof part also having a circular arch-shaped cross-section (shaped as a part of a torus), a dispensing element positioned between the lower part of the internal floor of the container and the inner and outer roof parts, the dispensing element including (a) a plate part which comprises a flat forward portion and a flat rearward portion, the flat rearward portion extending at a downward angle compared to the flat forward portion when the flat forward portion is horizontally oriented, (b) a skirt part which is connected to the plate part, the skirt part having a circular arch-shaped cross-section, the circular portion of the skirt part lying adjacent to and coincident with the lower part of the internal floor of the container when the flat forward portion of the plate part is horizontally oriented, (c) a concave wall part which connects the forward edge of the flat forward portion of the plate part and the nearest edge of the skirt part, and (d) a handle which extends from the concave wall part to a point outside the container side walls, the handle, when operated, being capable of pivoting the dispensing element to emit a fixed quantity of granular materials, the dispensing element being dimensioned such that when in its closed position the forward edge of the flat forward portion thereof will abut the lower edge of the outer roof part of the container and when in its fully open position the edge of the skirt part nearest the flat rearward portion will abut the inner edge of the inner roof part of the container, and a spring means connected to the dispensing element to bias it into a non-dispensing position.

2. The device as defined in claim 1 wherein a shoulder is formed between the concave wall part of the dispensing element and the skirt part, and wherein the spring means includes a U-shaped portion located within the dispensing element to abut the shoulder and extending arm portions which respectively extend outwardly through openings in opposite sides of the dispensing element to connect with the container side wall.

* * * * *